US007762178B2

(12) United States Patent
Scharp

(10) Patent No.: US 7,762,178 B2
(45) Date of Patent: Jul. 27, 2010

(54) TWO-PART PISTON FOR AN INTERNAL COMBUSTION ENGINE

(75) Inventor: Rainer Scharp, Vaihingen (DE)

(73) Assignee: MAHLE International GmbH, Stuttgart (DE)

( * ) Notice: Subject to any disclaimer, the term of this patent is extended or adjusted under 35 U.S.C. 154(b) by 352 days.

(21) Appl. No.: 12/002,113

(22) Filed: Dec. 14, 2007

(65) Prior Publication Data

US 2008/0307958 A1 Dec. 18, 2008

(30) Foreign Application Priority Data

Jun. 13, 2007 (DE) ..... 10 2007 027 162

(51) Int. Cl.
*F01B 31/08* (2006.01)

(52) U.S. Cl. ..... 92/186

(58) Field of Classification Search ..... 92/186, 92/216, 217, 219

See application file for complete search history.

(56) References Cited

U.S. PATENT DOCUMENTS

| | | | | |
|---|---|---|---|---|
| 6,026,777 | A | 2/2000 | Kemnitz et al. | |
| 6,327,962 | B1 * | 12/2001 | Kruse | 92/186 |
| 6,557,514 | B1 | 5/2003 | Gaiser | |
| 6,698,391 | B1 | 3/2004 | Kemnitz | |
| 6,938,537 | B2 | 9/2005 | Scharp | |
| 6,957,638 | B2 | 10/2005 | Scharp | |
| 7,409,903 | B2 * | 8/2008 | Scharp | 92/186 |
| 2003/0051694 | A1 | 3/2003 | Gaiser et al. | |
| 2007/0289568 | A1 * | 12/2007 | Scharp et al. | 123/193.6 |

FOREIGN PATENT DOCUMENTS

| | | |
|---|---|---|
| DE | 198 46 152 | 4/2000 |
| DE | 102 44 512 | 4/2004 |
| DE | 103 25 914 | 12/2004 |
| DE | 103 26 456 | 12/2004 |
| DE | 103 46 822 | 4/2005 |
| DE | 10 2004 058 968 | 6/2006 |
| JP | 2003-025076 | 1/2003 |
| WO | WO 2006060987 A1 * | 6/2006 |

* cited by examiner

*Primary Examiner*—Michael Leslie
(74) *Attorney, Agent, or Firm*—Collard & Roe, P.C.

(57) ABSTRACT

A two-part piston for an internal combustion engine consists of an upper part, a lower part and a circumferential, closed cooling channel radially on the outside and close to the piston crown. The channel is closed off, on its underside, by a cooling channel cover which is connected via a skirt connection with two skirt elements that lie opposite one another. In order to reduce the piston weight and nevertheless avoid secondary movements of the piston, circumferential recesses are provided in the region of the skirt elements, which are delimited by the cooling channel cover on the piston crown side and by the skirt connections on the skirt side. The skirt connections are connected with the radially inner region of the cooling channel cover on the piston crown side, and with the upper regions of the skirt elements on the skirt side.

4 Claims, 1 Drawing Sheet

TWO-PART PISTON FOR AN INTERNAL COMBUSTION ENGINE

CROSS-REFERENCE TO RELATED APPLICATIONS

This application claims priority under 35 USC 119 from German Application No. De 10 2007 027 162.1, filed on Jun. 13, 2007.

BACKGROUND OF THE INVENTION

1. Field of the Invention

The invention relates to a two-part piston for an internal combustion engine.

2. The Prior Art

A two-part piston for an internal combustion engine is described in U.S. Pat. No. 6,557,514 B1, which consists of an upper part and a lower part. The piston has a circumferential cooling channel radially on the outside and close to the piston crown. The channel is closed off by the upper part on the piston crown side and by a cooling channel cover, which is part of the lower part, on the skirt side. Two skirt elements that lie opposite one another are formed onto the radial outside of the cooling channel cover, and are connected with one another by way of two pin bosses that lie opposite one another. The pin bosses are each formed onto the cooling channel cover by a pin boss connection. The upper part and the lower part of this known piston are produced from steel.

Pistons consisting of an upper part and a lower part are usually produced for utility vehicles. These pistons therefore generally have relatively large dimensions and therefore a relatively great weight.

SUMMARY OF THE INVENTION

Proceeding from this, it is an object of the invention to reduce the weight of two-part pistons, particularly those produced for utility vehicles, without reducing their strength.

This task is accomplished according to the invention by a two-part piston for an internal combustion engine consisting of an upper part and a lower part connected with it. The upper part forms a piston crown, which has a ring belt formed onto it, radially on the outside. There is a circumferential, closed cooling channel disposed radially on the outside and close to the piston crown, and the upper region of the cooling channel facing the piston crown, is delimited by the upper part. The cooling channel is closed off, on its underside, by a cooling channel cover that is part of the lower part. There are two skirt elements each connected with the cooling channel cover by way of a skirt connection and lying opposite one another. There are two pin bosses each connected with the cooling channel cover by way of a pin boss connection, and lying opposite one another, which connect the skirt elements with one another. The skirt connections make a seamless transition into the pin boss connections, considered over the circumference of the piston.

There are circumferential recesses in the region of the skirt elements, which are delimited by the cooling channel cover on the piston crown side and by the skirt connections on the skirt side. The skirt connections are connected with the radially inner region of the cooling channel cover on the piston crown side, and with the upper regions of the skirt elements on the skirt side.

In this regard, parts of the skirt connection are relocated radially inward, because of the recesses, thereby causing the mass and therefore the weight of these parts to be reduced, because of their lesser radius. Because the skirt connections are connected with the radially inner region of the cooling channel cover on the piston crown side, the strength of the piston is maintained, and secondary movements of the piston are avoided, to a great extent.

In one embodiment, there are recesses having a cross sectional shape of circle segments, that run around the circumference in the region of the pin boss connections, and make a continuous transition into the recesses disposed in the region of the skirt elements. The skirt connections can be configured at least approximately in a truncated cone shape in the region of the skirt elements, and form an angle $\alpha$ of approximately 45° with the piston axis in these regions.

Preferably, the maximal axial dimension "h" of the recesses between the upper side of the skirt elements and the underside of the ring belt approximately corresponds to the dimension between the underside of the ring belt and the upper surface of the piston crown.

BRIEF DESCRIPTION OF THE DRAWINGS

Other objects and features of the present invention will become apparent from the following detailed description considered in connection with the accompanying drawing. It is to be understood, however, that the drawing is designed as an illustration only and not as a definition of the limits of the invention.

The single drawing shows a sectional diagram of a two-part cooling channel piston according to one embodiment of the invention, consisting of an upper part and a lower part, having recesses between the lower cooling channel cover and the upper region of the skirt elements and in the region of the pin boss connections.

DETAILED DESCRIPTION OF THE PREFERRED EMBODIMENT

Figure 1:
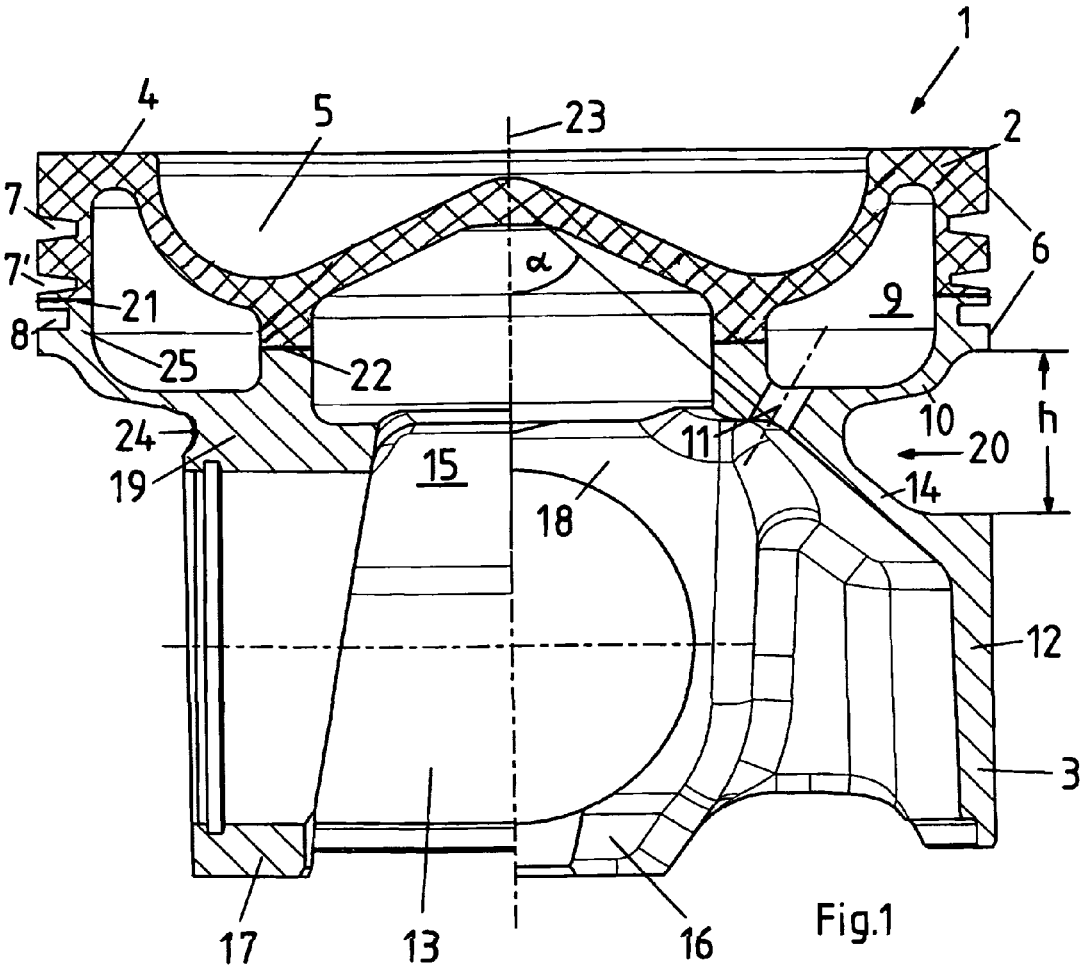

The piston 1, shown in section in the FIGURE, consists of an upper part 2 and a lower part 3. Upper part 2 forms a piston crown 4, into which a combustion bowl 5 is formed. Radially on the outside, piston 1 has a circumferential ring belt 6, close to piston crown 4, having grooves 7, 7', 8 for accommodating piston rings, not shown in the FIGURE. Grooves 7, 7' are formed into upper part 2 of piston 1.

On the piston crown side, upper part 2 delimits a closed cooling channel 9 that runs circumferentially, radially on the outside, and is closed off by a cooling channel cover 10 on the underside that faces away from the piston crown side, which cover is part of lower part 3, and has an opening 11 for the introduction of cooling oil into cooling channel 9, and another opening, not shown in the FIGURE, for passing cooling oil out of cooling channel 9. A collar 25, directed upward, is formed onto cooling channel cover 10 on the piston crown side, radially on the outside, into which collar groove 8 of ring belt 6 is formed, radially on the outside, to accommodate an oil control ring not shown in the FIGURE.

Lower part 3 furthermore has two skirt elements 12, 13 that lie opposite one another, of which the right half-section of the sectional diagram, which lies parallel to the major thrust/minor thrust direction of piston 1, shows the one skirt element 12 in section, and of which the left half-section of the sectional diagram, which lies perpendicular to the section plane of the right half-section, shows the other skirt element 13 in a top view.

Skirt elements 12, 13 are connected with lower cooling channel cover 10 by way of a skirt connection 14, 15, in each instance. Skirt elements 12, 13 are connected with one another by way of two pin bosses 16, 17 that lie opposite one another and are each formed onto cooling channel cover 10 by way of a pin boss connection 18, 19. In this regard, skirt connections 14, 15 make a seamless transition into pin boss connections 18, 19, considered over the circumference of piston 1.

Between each of skirt elements 12, 13 and ring belt 6, piston 1 has a recess 20 that is delimited on the piston crown side by cooling channel cover 10 and on the skirt side by skirt connections 14, 15. The undersides of skirt connections 14, 15 are connected with the upper sides of skirt elements 12, 13, and the upper sides of skirt connections 14, 15 are connected with the radially inner region of the cooling channel cover 10. From this, the result is obtained that skirt connections 14, 15 are configured at least approximately in truncated cone shape in the region of the skirt elements 12, 13, and form an angle $\alpha$ of approximately 45° with piston axis 23 in this region. The maximal axial dimension h of recesses 20 between the upper side of skirt elements 12, 13 and the underside of ring belt 6 approximately corresponds to the dimension between the underside of ring belt 6 and the upper surface of piston crown 4.

Furthermore, recesses 24 in the shape of circle segments, in section, are formed into pin boss connections 18, 19, radially on the outside, which recesses make a continuous transition into recesses 20 disposed in the region of skirt elements 12, 13. Recesses 20 lead to a further reduction in the piston weight.

Upper part 2 and lower part 3 of piston 1 can be produced from cast iron, from steel, or from light metal, for example from aluminum or magnesium. It is advantageous to produce upper part 2, which is directly exposed to the combustion gases, from steel, and the lower part 3 from aluminum, in order to save weight. Upper part 2 and lower part 3 can be connected by way of ring-shaped contact regions 21 and 22, using a welding method, such as the friction-welding method, for example, or using the hard-soldering method. It is also possible to screw upper part 2 onto lower part 3.

Accordingly, while only a few embodiments of the present invention have been shown and described, it is obvious that many changes and modifications may be made thereunto without departing from the spirit and scope of the invention.

REFERENCE SYMBOL LIST h axial dimension
1 piston
2 upper part of piston 1
3 lower part of piston 1
4 piston crown
5 combustion bowl
6 ring belt
7, 7', 8 groove
9 cooling channel
10 cooling channel cover
11 opening
12, 13 skirt element
14, 15 skirt connection
16, 17 pin boss
18, 19 pin boss connection
20 recess
21, 22 contact region
23 piston axis
24 recess
25 collar

What is claimed is:

1. A two-part piston for an internal combustion engine, comprising;

an upper part comprising a piston crown and a ring belt formed radially on an outside of the piston crown;

a lower part connected with the upper part;

a circumferential, closed cooling channel disposed radially on an outside of the piston and close to the piston crown, wherein an upper region of the cooling channel facing the piston crown is delimited by the upper part;

a cooling channel cover that closes off the cooling channel on its underside, the cooling channel cover being formed by the lower part;

a collar formed onto an outside radius of the cooling channel cover, said collar being directed upwardly toward the piston crown and onto which collar grooves of a ring belt are formed;

two skirt elements each connected with the cooling channel cover by way of a skirt connection, and lying opposite one another;

two pin bosses each connected with the cooling channel cover by way of a pin boss connection, and lying opposite one another, said pin bosses connecting the skirt elements with one another, wherein the skirt connections make a seamless transition into the pin boss connections, considered over a circumference of the piston; and circumferential recesses in a region of the skirt elements, said recesses being delimited by the cooling channel cover on a piston crown side and by the skirt connections on a skirt side, wherein the skirt connections are connected with a radially inner region of the cooling channel cover on the piston crown side, and with upper regions of the skirt elements on the skirt side.

2. A piston according to claim 1, further comprising additional recesses having a cross-sectional shape of circle segments, said additional recesses running around the circumference of the piston in a region of the pin boss connections, said additional recesses making a continuous transition into the recesses disposed in the region of the skirt elements.

3. A piston according to claim 1, wherein the skirt connections are configured approximately in a truncated cone shape at least in the region of the skirt elements, and form an angle $(\alpha)'$ of approximately less than or equal to 45° with a piston axis in these regions.

4. A piston according to claim 1, wherein a maximal axial dimension (h) of the recesses between the upper side of the skirt elements and an underside of the ring belt is less than or equal to a distance between the underside of the ring belt and an upper surface of the piston crown.

* * * * *